US007671599B1

(12) United States Patent
Tan et al.

(10) Patent No.: US 7,671,599 B1
(45) Date of Patent: Mar. 2, 2010

(54) STATIC ELECTRICITY MONITOR COMPRISING A WALKING FOOTPAD ELECTRODE AND HANDRAIL ELECTRODE

(75) Inventors: Huynh P. Tan, San Jose, CA (US); Julius A. Turangan, Livermore, CA (US); Muralidhar R. Dugyala, Milpitas, CA (US)

(73) Assignee: Western Digital Technologies, Inc., Lake Forest, CA (US)

( * ) Notice: Subject to any disclaimer, the term of this patent is extended or adjusted under 35 U.S.C. 154(b) by 206 days.

(21) Appl. No.: 11/700,427

(22) Filed: Jan. 31, 2007

(51) Int. Cl.
*G01N 27/60* (2006.01)
*A61B 5/05* (2006.01)

(52) U.S. Cl. ..... 324/452; 600/547

(58) Field of Classification Search ..... 324/452
See application file for complete search history.

(56) References Cited

U.S. PATENT DOCUMENTS

| | | | | |
|---|---|---|---|---|
| 3,596,134 | A | | 7/1971 | Burke |
| 4,590,623 | A | | 5/1986 | Kitchman |
| 4,596,053 | A | | 6/1986 | Cohen et al. |
| 4,639,825 | A | | 1/1987 | Breidegam |
| 4,736,157 | A | | 4/1988 | Betker et al. |
| 4,745,519 | A | | 5/1988 | Breidegam |
| 4,800,374 | A | | 1/1989 | Jacobson |
| 5,422,630 | A | | 6/1995 | Quinn et al. |
| 5,440,444 | A | | 8/1995 | Adams |
| 5,519,384 | A | * | 5/1996 | Chanudet et al. ..... 340/649 |
| 5,548,469 | A | | 8/1996 | Adams |
| 5,666,106 | A | | 9/1997 | Nasman |
| 5,686,897 | A | | 11/1997 | Loh |
| 5,715,536 | A | | 2/1998 | Banks |
| 5,952,931 | A | | 9/1999 | Chotichanon et al. |
| 5,991,145 | A | | 11/1999 | Lagrotta et al. |
| 5,991,922 | A | | 11/1999 | Banks |
| 6,014,773 | A | | 1/2000 | Banks |
| 6,026,512 | A | | 2/2000 | Banks |
| 6,035,260 | A | | 3/2000 | Pohribnij et al. |
| 6,078,875 | A | | 6/2000 | Jubin et al. |
| 6,140,929 | A | | 10/2000 | Gannon |
| 6,272,694 | B1 | | 8/2001 | Weaver et al. |
| 6,510,987 | B1 | | 1/2003 | Hengriprasopchoke et al. |

(Continued)

OTHER PUBLICATIONS

Desco Industries, Inc., "Dual-Wire Workstation Continuous Monitor Installation, Operation, and Maintenance", Sep. 2006, Desco Technical Bulletin TB-3019, www.desco.com/pdf/tb-3019.pdf, 4 pages.

(Continued)

*Primary Examiner*—Jeff Natalini
(74) *Attorney, Agent, or Firm*—Howard H. Sheerin, Esq.

(57) ABSTRACT

A static electricity monitor is disclosed operable to test a garment worn by a person, the garment comprising a first piece of footwear worn on a first foot of the person. The static electricity monitor comprises a first footpad electrode having a length of at least one meter, and a first handrail electrode running generally parallel to the first footpad electrode. The static electricity monitor further comprises control circuitry coupled to the first footpad electrode and the first handrail electrode, and operable to determine if the garment worn by the person passes a soundness test by taking a measurement as the person walks the first piece of footwear along the first footpad electrode while contacting a first hand to the first handrail electrode.

19 Claims, 6 Drawing Sheets

U.S. PATENT DOCUMENTS

| | | | | |
|---|---|---|---|---|
| 6,577,287 | B2 | 6/2003 | Havel | |
| 6,714,814 | B2 * | 3/2004 | Yamada et al. | 600/547 |
| 6,767,603 | B1 | 7/2004 | Hurst et al. | |
| 6,809,522 | B2 * | 10/2004 | Nguyen | 324/457 |
| 2004/0198117 | A1 | 10/2004 | Caudell | |
| 2005/0278826 | A1 | 12/2005 | Kato | |
| 2006/0261818 | A1 * | 11/2006 | Zank et al. | 324/457 |

OTHER PUBLICATIONS

Office Action dated Nov. 25, 2008, from U.S. Appl. No. 11/637,527, 6 pages.

Office Action dated Jan. 26, 2009, from U.S. Appl. No. 11/637,527, 17 pages.

Office Action dated Jul. 21, 2009 from U.S. Appl. No. 11/637,527, 15 pages.

Office Action dated Oct. 19, 2009 from U.S. Appl. No. 11/637,527, 11 pages.

* cited by examiner

STATIC ELECTRICITY MONITOR COMPRISING A WALKING FOOTPAD ELECTRODE AND HANDRAIL ELECTRODE

BACKGROUND OF THE INVENTION

1. Field of the Invention

The present invention relates to static electricity monitors. More particularly, the present invention comprises a static electricity monitor comprising a walking footpad electrode and a handrail electrode.

2. Description of the Prior Art

Static electricity represents a serious threat to electronic components, which may become damaged during the manufacturing process when the personnel handling these components are not effectively grounded. It is desirable to ground not only the bodies of the personnel working with these components, but their clothing as well, as charge can build up in either location. To this end, the personnel typically wear a protective dissipative garment that is grounded, for example, by wearing footwear having electrically conductive soles that dissipate the charge to the work surface.

If the dissipative garment is not worn correctly or has a defect, it may not properly ground the person. To address this problem, special equipment has been developed to test the person before entering the work environment to ensure they are properly grounded by the dissipative garment. For example, the person may stand on a first electrode (in the form of a footpad) while contacting a second electrode with their hand. A small current is generated and the resistance measured across the electrodes to measure the resistance of the person. If the resistance is too high or too low, an alarm notifies the person to take corrective action.

A problem with the prior art "standing" footpad technique for testing a dissipative garment is the bottleneck it creates when a large number of personnel are entering the work environment, for example, in the morning or after lunch. It requires each person stop at the testing station, step on the footpad, place their hand on the second electrode, and then wait for the test result. This bottleneck can significantly reduce productivity of the work environment, particularly when there are a large number of people attempting to enter the work environment at one time.

There is, therefore, a need to reduce the bottleneck associated with testing the soundness of dissipative garments worn by personnel entering a work environment.

SUMMARY OF THE INVENTION

An embodiment of the present invention comprises a static electricity monitor operable to test a garment worn by a person, the garment comprising a first piece of footwear worn on a first foot of the person. The static electricity monitor comprises a first footpad electrode having a length of at least one meter, and a first handrail electrode running generally parallel to the first footpad electrode. The static electricity monitor further comprises control circuitry coupled to the first footpad electrode and the first handrail electrode, and operable to determine if the garment worn by the person passes a soundness test by taking a measurement as the person walks the first piece of footwear along the first footpad electrode while contacting a first hand to the first handrail electrode.

In one embodiment, the control circuitry is further operable to apply a current to at least one of the first footpad electrode and the first handrail electrode. In one embodiment, the control circuitry further comprises an ohmmeter operable to measure a resistance between the first footpad electrode and the first handrail electrode in order to determine if the garment worn by the person passes the soundness test.

In another embodiment, the garment further comprises a second piece of footwear worn on a second foot of the person, the static electricity monitor further comprising a second footpad electrode having a length of at least one meter and running generally parallel to the first footpad electrode, the control circuitry is further operable to determine if the garment worn by the person passes the soundness test by taking a measurement as the person walks the second piece of footwear along the second footpad electrode while contacting the first hand to the first handrail electrode.

In yet another embodiment, the static electricity monitor further comprises a second handrail electrode running generally parallel to the first footpad electrode, wherein the control circuitry is further operable to determine if the garment worn by the person passes the soundness test by taking a measurement as the person walks the first piece of footwear along the first footpad electrode while contacting a second hand to the second handrail electrode.

In still another embodiment, the static electricity monitor further comprises a second handrail electrode running generally parallel to the second footpad electrode, wherein the control circuitry is further operable to determine if the garment worn by the person passes the soundness test by taking a measurement as the person walks the second piece of footwear along the second footpad electrode while contacting a second hand to the second handrail electrode.

In another embodiment, the static electricity monitor further comprises a sensor operable to detect when the person enters a testing zone associated with the static electricity monitor. In another embodiment, the static electricity monitor further comprises a sensor operable to detect when the person exits a testing zone associated with the static electricity monitor. In yet another embodiment, the static electricity monitor further comprises a second handrail electrode in-line with the first handrail electrode and running generally parallel to the first footpad electrode, a first sensor operable to detect when the person enters a first testing zone associated with the first handrail electrode, and a second sensor operable to detect when the person enters a second testing zone associated with the second handrail electrode.

In still another embodiment, the control circuitry is further operable to activate an alarm if the garment worn by the person does not pass the soundness test. In another embodiment, the static electricity monitor further comprises a gate near an exit of a testing zone associated with the static electricity monitor, wherein the control circuitry is further operable to unlock the gate if the garment worn by the person passes the soundness test.

Another embodiment of the present invention comprises a method of testing a soundness of a garment worn by a person, the garment comprising a first piece of footwear worn on a first foot of the person. The method comprises the person walking the first piece of footwear along a first footpad electrode while contacting a first hand to a first handrail electrode, taking a measurement between the first footpad electrode and the first handrail, and determining whether the garment worn by the person passes a soundness test based on the measurement.

DESCRIPTION OF THE PREFERRED EMBODIMENTS

Figure 1:
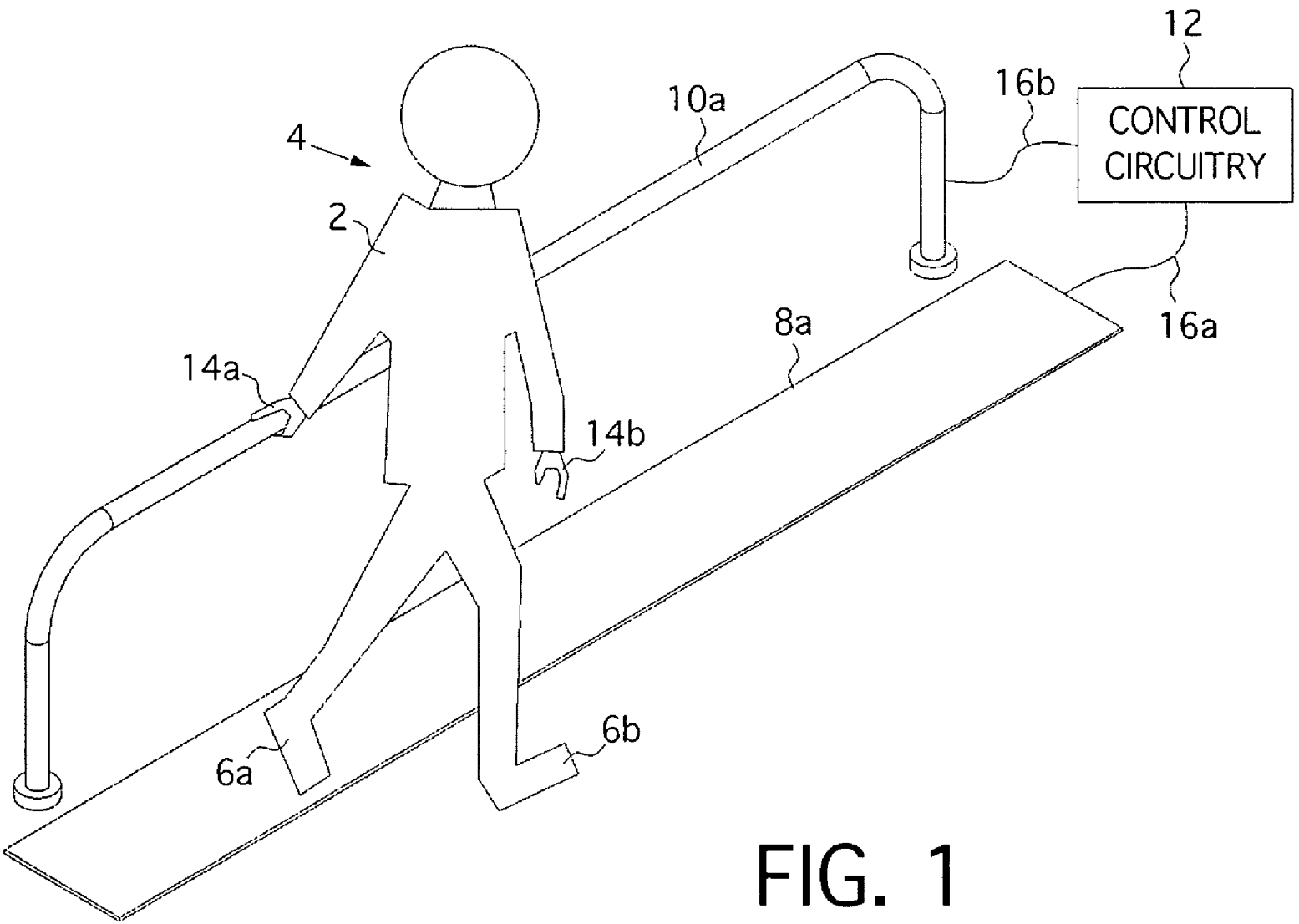
FIG. 1 shows a static electricity monitor according to an embodiment of the present invention comprising control circuitry operable to determine if a garment worn by a person passes a soundness test by taking a measurement as the person walks a first piece of footwear along a first footpad electrode while contacting a first handrail electrode with a first one of their hands.

FIG. 1 shows a static electricity monitor operable to test a garment 2 worn by a person 4 according to an embodiment of the present invention, the garment 2 comprising a first piece of footwear 6*a* worn on a first foot of the person 4. The static electricity monitor comprises a first footpad electrode 8*a* having a length of at least one meter, and a first handrail electrode 10*a* running generally parallel to the first footpad electrode 8*a*. The static electricity monitor further comprises control circuitry 12 coupled to the first footpad electrode 8*a* and the first handrail electrode 10*a*, and operable to determine if the garment 2 worn by the person 4 passes a soundness test by taking a measurement as the person 4 walks the first piece of footwear 6*a* along the first footpad electrode 8*a* while contacting a first hand 14*a* to the first handrail electrode 10*a*.

In contrast to prior art static electricity monitors that require the person being tested to stop walking in order to be tested, in the embodiments of the present invention the person is tested while walking along the footpad electrode 8*a* as illustrated in FIG. 1. If the person passes the soundness test (as indicated by a suitable signal, such as an audible or visual signal), the person simply continues walking into the work environment without stopping which can significantly reduce the bottleneck in testing each person. Configuring the handrail electrode 10*a* to be generally parallel to the footpad electrode 8*a* enables the person to walk along the footpad electrode 8*a* while contacting a hand 14*a* to the first handrail electrode. The handrail electrode 10*a* may be generally parallel to the footpad electrode within any suitable degree of tolerance.

The footpad electrode 8*a* may comprise any suitable material for conducting electricity, such as a metal plate or a suitable fabric or other composite comprising an electrically conductive element, such as carbon fiber. The footpad electrode 8*a* may also comprise any suitable length that facilitates one or more people walking along the electrode 8*a*. In an embodiment described below with reference to FIG. 5, the footpad electrode comprises two or more meters extending through multiple testing zones to facilitate the concurrent testing of multiple people as they walk along the footpad electrode 8*a*. The handrail electrode 10*a* may also comprise any suitable material in any suitable configuration, such as a metal rod or a metal plated rod.

In one embodiment, the first piece of footwear 6*a* comprises a suitable conductor for interfacing with the first footpad 8*a*, such as an outer sole comprising conductive material or some other conductor coupled to the material forming the first piece of footwear 6*a*. The garment 2 may be electrically coupled to the person 4 (e.g., at the foot or wrist) so that while the person 4 is operating normally in a work environment, the garment 2 dissipates static electricity from the person 4 through the footwear 6*a* and 6*b* to a dissipative flooring. The static electricity monitor of FIG. 1 may be used to ensure that the garment 2 is sound (e.g., not defective and being worn correctly) prior to the person 4 entering the work environment.

Any garment may be used to ground the person as described above. In one embodiment, a garment, such as that described in U.S. patent application Ser. No. 11/508,766, "STATIC CONTROL GARMENT," filed on Aug. 23, 2006, the contents of which are hereby incorporated in their entirety, may be used.

A first lead 16*a* electrically couples the first footpad electrode 8*a* to the control circuitry 12, and a second lead 16*b* electrically couples the first handrail electrode 10*a* to the control circuitry 12. Any suitable control circuitry may be employed in the embodiments of the present invention, including any suitable analog and/or digital control circuitry, which may include a microprocessor executing steps of a control program or suitable state machine circuitry. In one embodiment, the control circuitry 12 may compensate for invalid measurements due to the piece of footwear 6*a* being lifted off the first footpad electrode 8*a* as the person walks along the first footpad electrode 8*a*, or due to the person's hand 14*a* temporarily losing contact with the first handrail electrode 10*a*. For example, the control circuitry 12 may comprise suitable filtering circuitry and/or software for filtering out the invalid measurements.

In one embodiment, the footpad electrode 8*a* and the handrail electrode 10*a* are electrically insulated from the ground, for example, by employing a suitable insulator on the bottom surface of the footpad electrode 8*a* and a suitable insulator near the ends of the handrail electrode 10*a*. In such an embodiment, the control circuitry 12 may apply a current to at least one of the first footpad electrode 8*a* and the first handrail electrode 10*a*, and perform a soundness test in response to the current. For example, in one embodiment, the control circuitry 12 comprises an ohmmeter operable to measure a resistance between the first footpad electrode 8*a* and the first handrail electrode 10*a* in order to determine if the garment 2 worn by the person 4 passes the soundness test. Since the footpad electrode 8*a* and the handrail electrode 10*a* are effectively insulated from one another except via the person 4 and garment 2, the control circuitry 12 will indicate that the garment 2 has passed the soundness test as long as the resistance is within an acceptable range. If the resistance is too high, it may indicate, inter alia, that the garment 2 is defective or that the garment 2 is not making good electrical contact with the person's skin. On the other hand, if the resistance is too low, it may indicate, inter alia, that the garment 2 again is defective or that the control circuitry 12 is taking an incorrect reading.

Measuring a resistance between the first footpad electrode 8*a* and the first handrail electrode 10*a* is merely an embodiment of the present invention; however, any suitable measurement may be taken. For example, in an alternative embodiment the control circuitry 12 may comprise a suitable nanocoulomb meter for measuring static charge between the first footpad electrode 8*a* and the first handrail electrode 10*a*. In another embodiment, the control circuitry 12 may comprise a suitable volt meter for measuring a potential between the first footpad electrode 8*a* and the first handrail electrode 10*a*. In yet another embodiment, the control circuitry 12 may comprise a suitable electrostatic meter for measuring an electric field emitted by the person's body while the person's foot is on the first footpad electrode 8*a* and the person's hand is on the first handrail electrode 10*a*.

Figure 2:
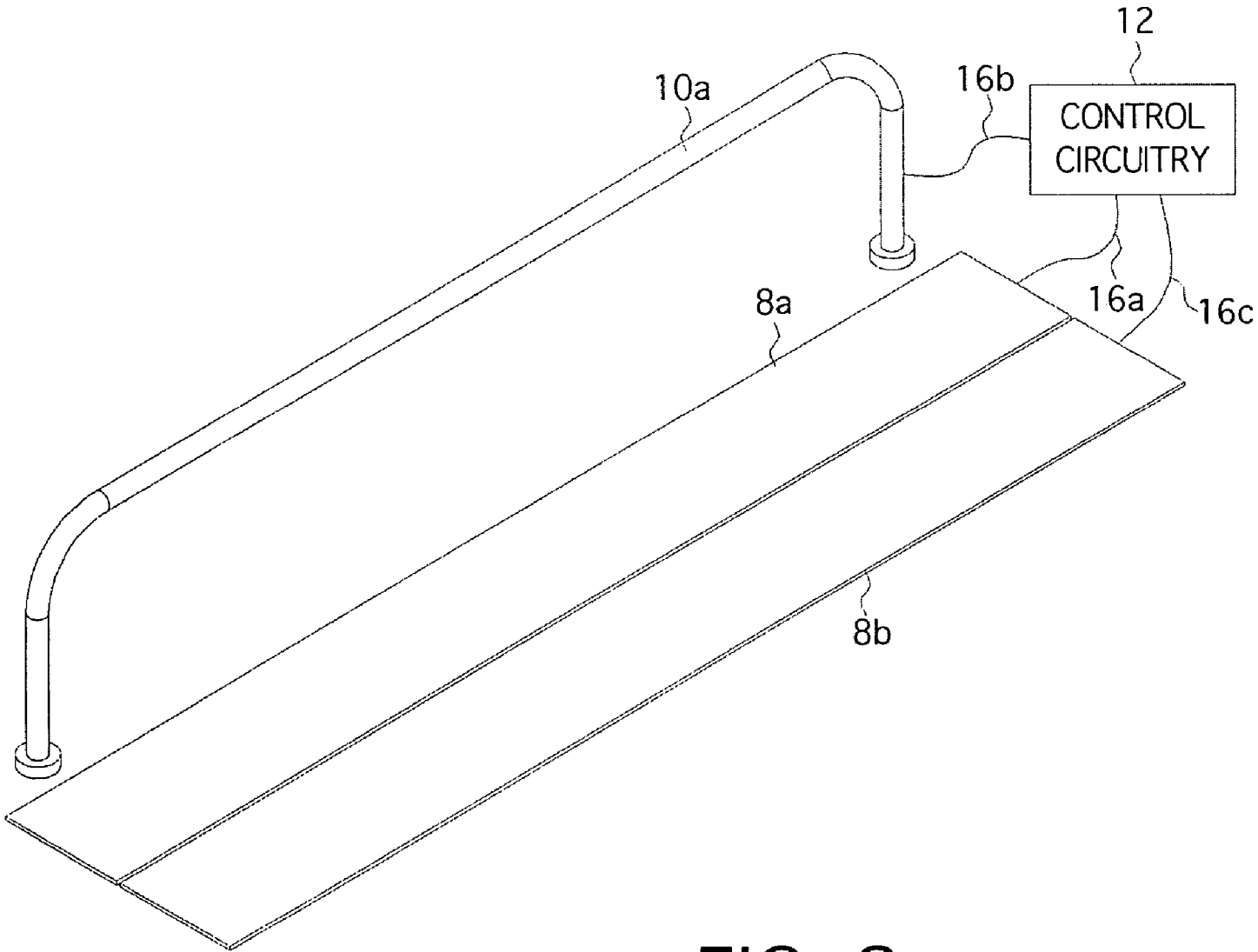
FIG. 2 shows a static electricity monitor according to an embodiment of the present invention wherein the person walks a second piece of footwear along a second footpad electrode.

FIG. 2 shows an embodiment of the present invention wherein the static electricity monitor further comprises a second footpad electrode 8*b* having a length of at least one meter and running generally parallel to the first footpad electrode 8*a*. The control circuitry 12 is further operable to determine if the garment 2 worn by the person 4 passes the soundness test by taking a measurement as the person walks a second piece of footwear 6*b* along the second footpad electrode 8*b* while contacting the first hand 14*a* to the first handrail electrode 10*a*.

In one embodiment, the first and second footpad electrodes 8 and 8*b* are electrically insulated from one another, and a lead 16*c* electrically couples the second footpad electrode 8*b* to the control circuitry 12. For example, in one embodiment a bottom surface of the first and second footpad electrodes 8*a* and 8*b* comprises an insulating material. In this embodiment, the control circuitry 12 may take independent measurements for each of the first and second footpad electrodes 8*a* and 8*b* relative to the first handrail electrode 10*a*. In an alternative embodiment, the first and second footpad electrodes 8*a* and 8*b* are shorted together (e.g., by shorting leads 16*a* and 16*c*), and the control circuitry 12 takes one measurement for both footpad electrodes 8*a* and 8*b* relative to the first handrail electrode 10*a*.

Figure 3:
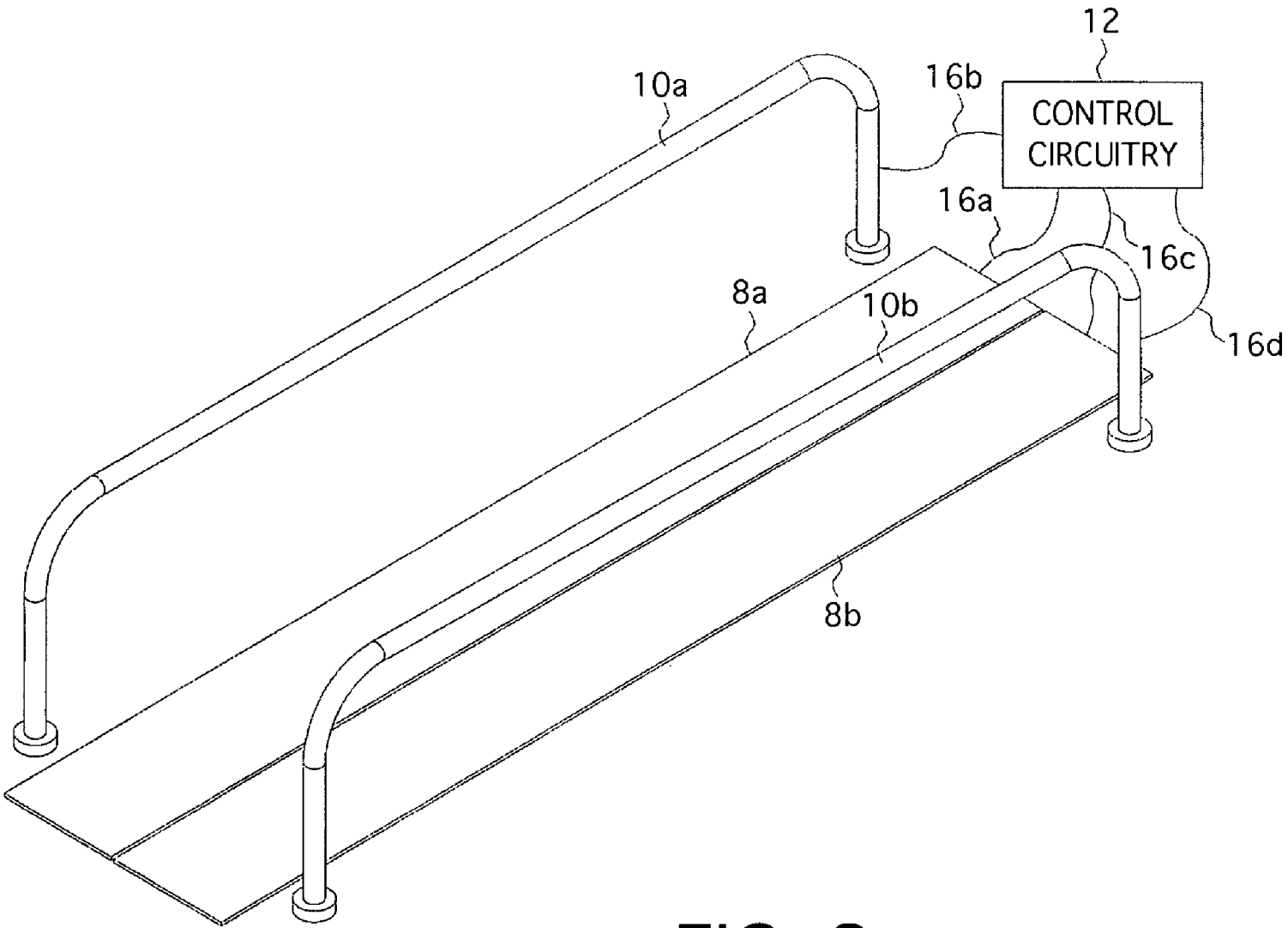
FIG. 3 shows a static electricity monitor according to an embodiment of the present invention wherein the person contacts a second handrail electrode with a second hand.

FIG. 3 shows an embodiment of the present invention wherein the static electricity monitor further comprises a second handrail electrode 10*b* running generally parallel to the first footpad electrode 8*a*, wherein the control circuitry 12 is further operable to determine if the garment 2 worn by the person 4 passes the soundness test by taking a measurement as the person 4 walks the first piece of footwear 6*a* along the first footpad electrode 8*a* while contacting a second hand 14*b* to the second handrail electrode 10*b*. Such a static electricity monitor may or may not comprise the second footpad electrode 8*b* for interfacing with the second piece of footwear 6*b* worn by the person 4.

In one embodiment, the first and second handrail electrodes 10*a* and 10*b* are electrically insulated from one another, and a lead 16*d* electrically couples the second handrail electrode 10*b* to the control circuitry 12. In this embodiment, the control circuitry 12 may take independent measurements for each of the first and second handrail electrodes 10*a* and 10*b* relative to the first footpad electrode 8*a* (and possibly the second footpad electrode 8*b*). In an alternative embodiment, the first and second handrail electrodes 10*a* and 10*b* are shorted together (e.g., by shorting leads 16*b* and 16*d*), and the control circuitry 12 takes one measurement for both handrail electrodes 10*a* and 10*b* relative to the first footpad electrode 8*a* (and possibly the second footpad electrode 8*b*). The footpad electrodes 8*a* and 8*b* may be measured independently relative to the handrail electrodes 10*a* and 10*b*, or they may be shorted together and one measurement taken relative to each or both handrail electrodes 10*a* and 10*b*.

In the embodiment wherein the handrail electrodes 10*a* and 10*b* are electrically insulated from one another and the footpad electrodes 8*a* and 8*b* are electrically insulated from one another, the control circuitry 12 may comprise suitable multiplexing circuitry for periodically switching between the two measurements. For example, the control circuitry 12 may take a first measurement between the first handrail electrode 10*a* and the first footpad electrode 8*a*, and then take a second measurement between the second handrail electrode 10*b* and the second footpad electrode 8*b*. A suitable switching frequency may be selected that optimizes the probability of detecting when the person is touching either handrail electrode 10*a* or 10*b* while walking along the footpad electrodes 8*a* and 8*b*. Alternatively, the control circuitry 12 may comprise a first circuit for taking the first measurement between the first handrail electrode 10*a* and the first footpad electrode 8*a*, and a second circuit for taking the second measurement between the second handrail electrode 10*b* and the second footpad electrode 8*b*. Of course, in other embodiments, the control circuitry 12 may comprise any suitable circuitry for performing a soundness test.

Figure 4:
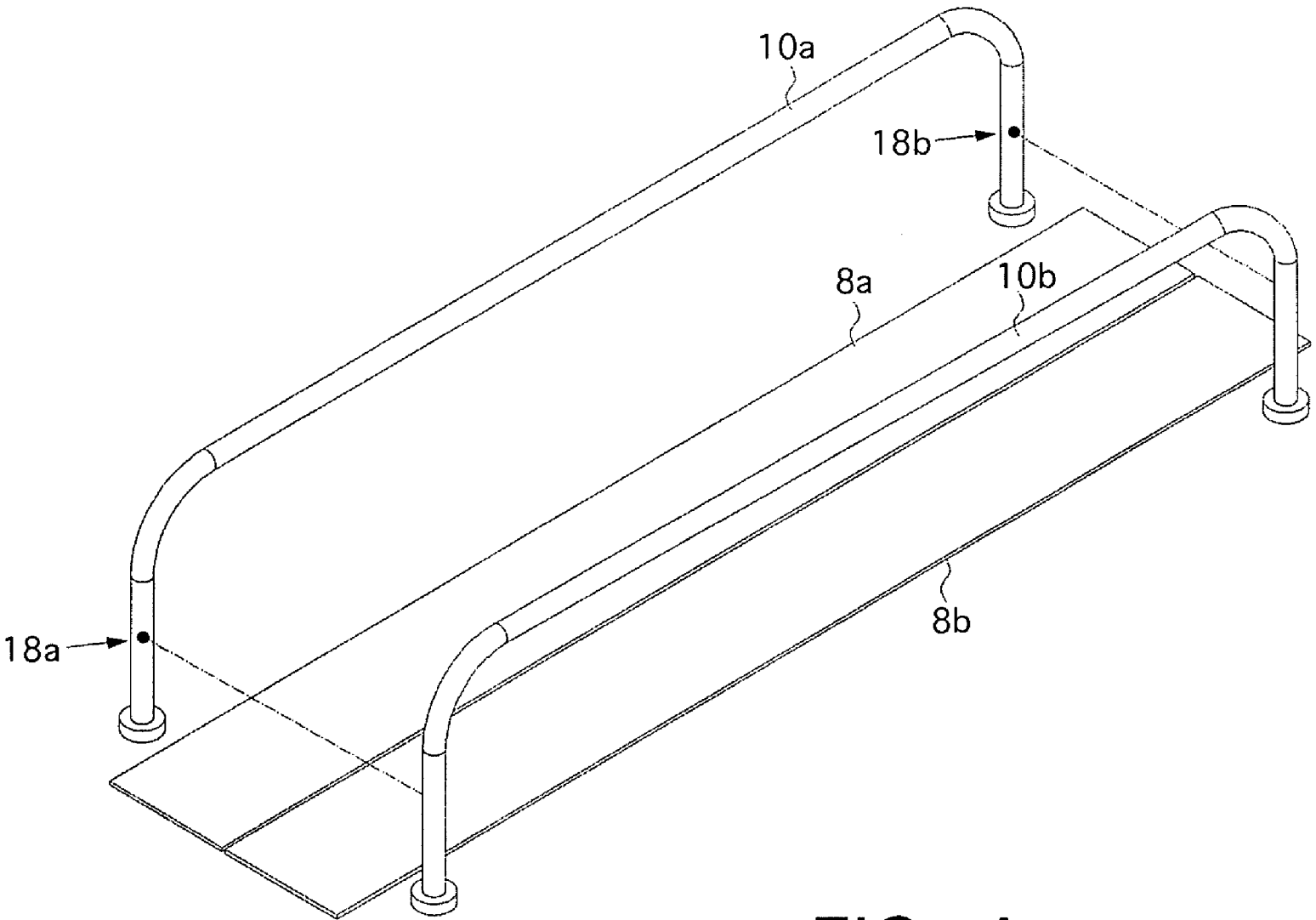
FIG. 4 shows a static electricity monitor according to an embodiment of the present invention further comprising a first sensor operable to detect when the person enters a testing zone associated with the static electricity monitor, and a second sensor operable to detect when the person exits a testing zone associated with the static electricity monitor.

FIG. 4 shows an embodiment of the present invention wherein the static electricity monitor further comprises a first entry sensor 18*a* operable to detect when the person 4 enters a testing zone associated with the static electricity monitor. In another embodiment, the static electricity monitor further comprises a first exit sensor 18*b* operable to detect when the person 4 exits a testing zone associated with the static electricity monitor. The entry and exit sensors 18*a* and 18*b* may comprise any suitable circuitry, such as an optical beam transmitter and detector as shown in FIG. 4, or alternatively pressure sensors located near the ends of the footpad electrodes 8*a* and 8*b*.

In one embodiment, the entry and exit sensors 18*a* and 18*b* help ensure only one person enters the static electricity monitor at a time. For example, if the first entry sensor 18*a* is triggered by a first person and then triggered by a following person before the first person exits the testing zone (as detected by the second sensor 18*b*), the control circuitry 12 may activate an alarm to notify the second person to re-enter the testing zone after the first person exits. Alternatively, a suitable signal (e.g., audible or visual signal) may be employed to notify the next person that the testing zone is ready for entry. In another embodiment, the entry and exit sensors 18*a* and 18*b* help ensure that the static electricity monitor accurately notifies each person 4 regarding whether or not the garment 2 has passed the soundness test. If the entry and exit sensors 18*a* and 18*b* are triggered consecutively without a measurement indicating that the garment 2 has passed the soundness test, the static electricity monitor can activate an alarm, or generate a suitable signal to indicate that the person 4 has failed the test.

Figure 5:
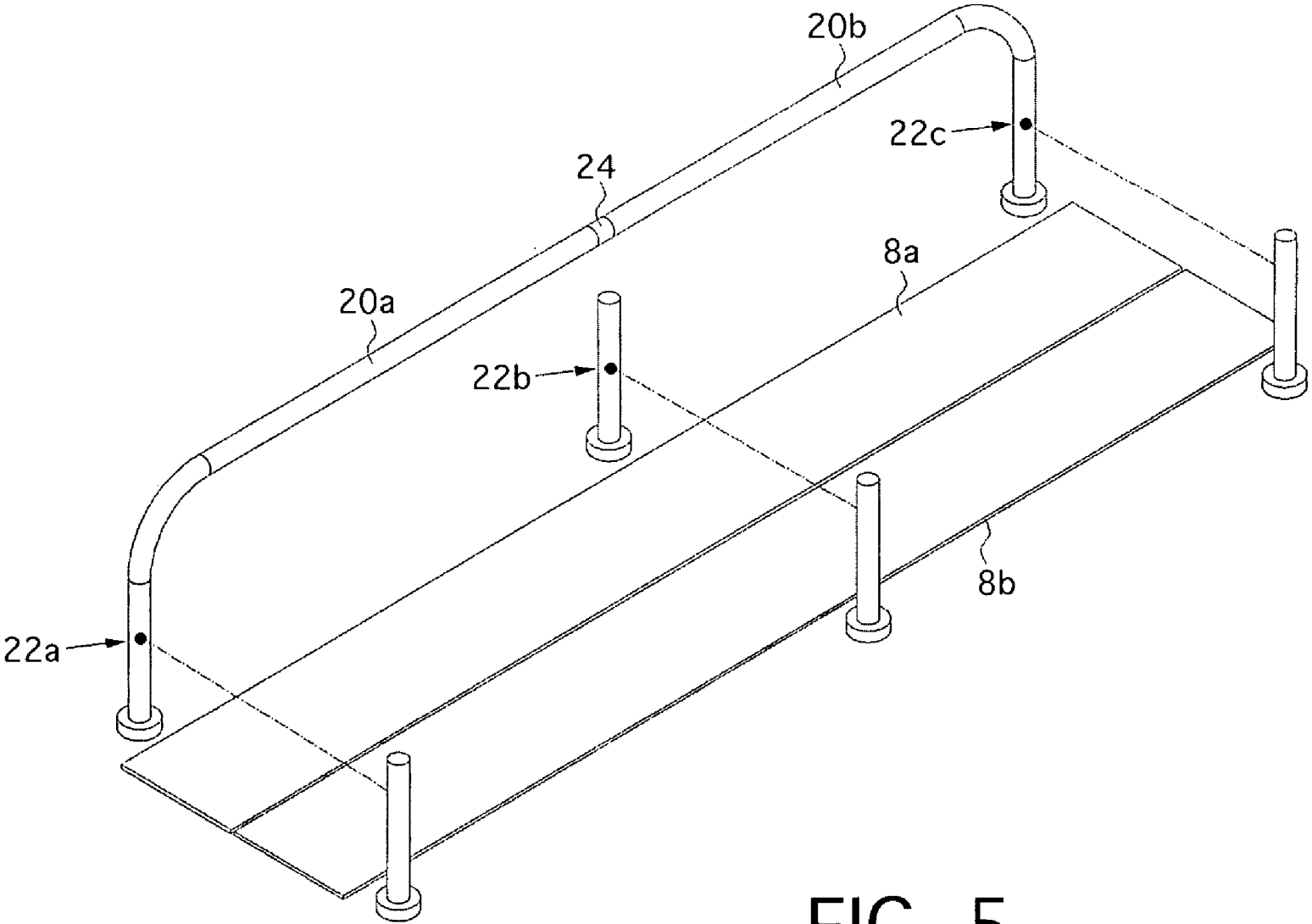
FIG. 5 shows a static electricity monitor according to an embodiment of the present invention comprising a first handrail and a second in-line handrail together with sensors that define two testing zones that may facilitate the testing of multiple persons concurrently.

FIG. 5 shows an embodiment of the present invention wherein the static electricity monitor comprises a first handrail electrode 20*a* in-line with a second handrail electrode 20*b* and running generally parallel to the first footpad electrode 8*a*, a first entry sensor 22*a* operable to detect when the person 4 enters a first testing zone associated with the first handrail electrode 20*a*, and a second entry sensor 22*b* operable to detect when the person 4 enters a second testing zone associated with the second handrail electrode 20*b*. In one embodiment, the static electricity monitor further comprises an exit sensor 20*c* for detecting when the person 4 exits the second testing zone. In the embodiment of FIG. 5, an insulator 24 electrically insulates the first handrail electrode 20*a* from the second handrail electrode 20*b* so that the control circuitry can take independent measurements relative to the footpad electrode 8*a* (and/or 8*b*). In another embodiment, the static electricity monitor may also comprise a second set of handrails for interfacing with the second hand 14*b* of the person 4. Any suitable number of testing zones may be employed in the embodiments of the present invention, wherein increasing the number of testing zones may further decrease the bottleneck involved with testing a large number of people entering a work environment.

In one embodiment, employing multiple testing zones enables more than one person to be tested concurrently. For example, a first person may not pass the soundness test while walking through the first testing zone associated with the first handrail electrode 20*a*. When the first person enters the second testing zone (as indicated by the sensors), a second person may enter the first testing zone while the first person walks through the second testing zone. The control circuitry 12 comprises suitable circuitry for taking independent measurements for each of the first and second testing zones, and for tracking each person as they walk through the testing zones. In one embodiment, at least part of the control circuitry 12 is duplicated for each testing zone, and in an alternative embodiment, the control circuitry 12 comprises suitable multiplexing circuitry for periodically selecting between the testing zones.

The static electricity monitor may employ any suitable technique for preventing a person from entering the work environment if their garment 2 fails the soundness test. In one embodiment, the control circuitry 12 activates an alarm (e.g., audible or visual alarm) if the garment 2 fails the soundness test. In another embodiment shown in FIG. 6, the static electricity monitor comprises a gate 24 near an exit of a testing zone associated with the static electricity monitor, wherein the control circuitry 12 is further operable to unlock the gate 24 prior to the person reaching the gate 24 if the garment 2 worn by the person 4 passes the soundness test. In this manner, the person is not required to stop walking in order to perform the soundness test but instead continues walking through the gate and into the work environment which can significantly reduce the bottleneck in testing each person. The embodiment of FIG. 6 may be implemented with a single footpad electrode 8*a* and/or a single handrail electrode 10*a* (similar to FIG. 1).

Figure 6:
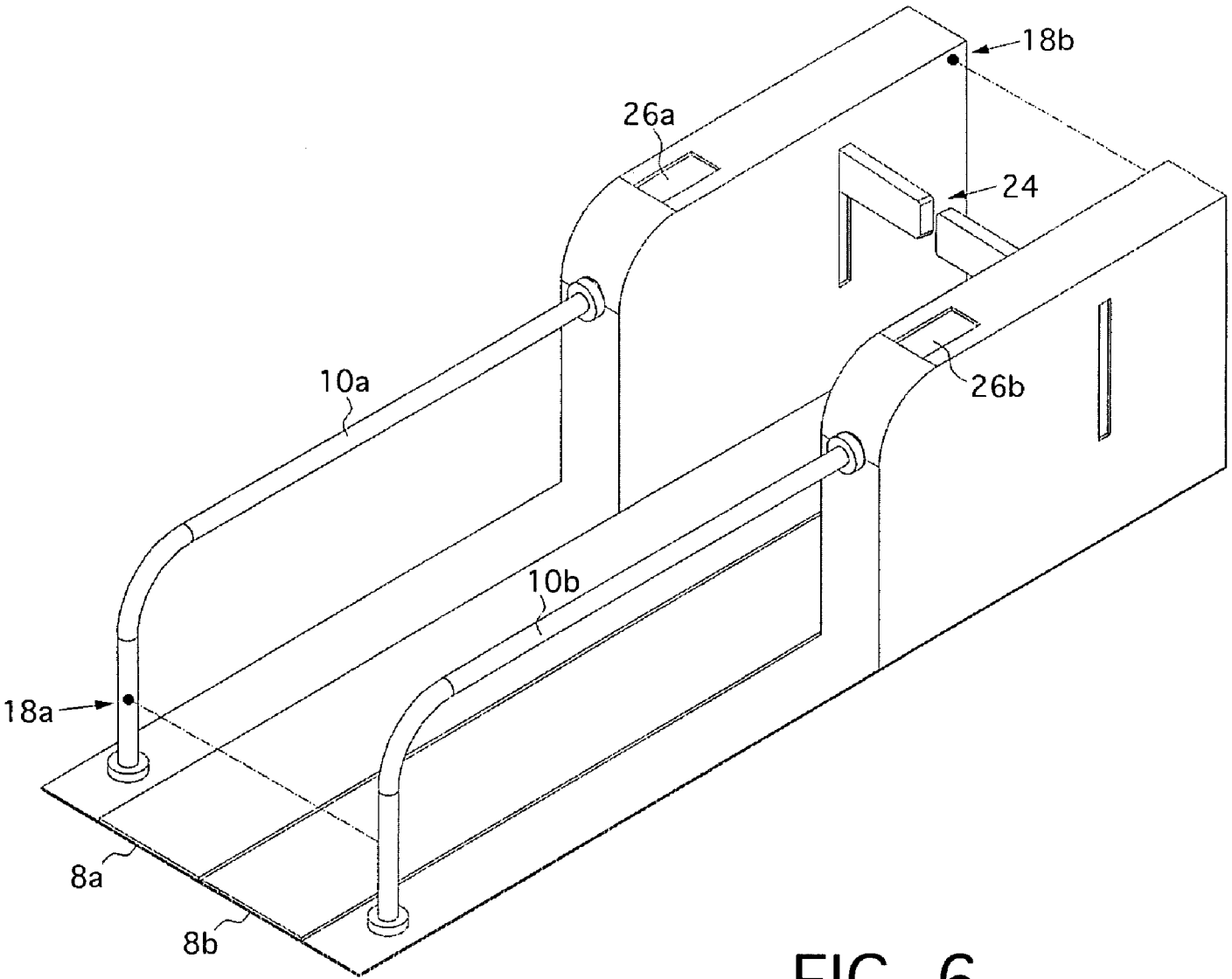
FIG. 6 shows a static electricity monitor according to an embodiment of the present invention wherein the control circuitry is further operable to unlock a gate if the garment worn by the person passes the soundness test.

The embodiment of FIG. 6 may also comprise other features, such as the entry and exit sensors 18*a* and 18*b*, or "last chance" handpad electrodes 26*a* and 26*b* wherein the person stops and places one or both hands (14*a* and/or 14*b*) on the handpad electrodes 26*a* and 26*b* as a last chance test before being rejected for failing the soundness test. If the person fails the soundness test, they may exit the static electricity monitor by turning around and walking out through the entry, or in an alternative embodiment, by exiting through a "side door" not shown in FIG. 6. For example, one or both of the handrail electrodes 10*a* and/or 10*b* may comprise a hinged segment that may be lifted to allow the person to exit the static electricity monitor. In one embodiment, the side door may comprise a suitable sensor for detecting when the person has exited so that the next person can be signaled to enter the monitor.

We claim:

1. A static electricity monitor operable to test a garment worn by a person, the garment comprising a first piece of footwear worn on a first foot of the person, the static electricity monitor comprising:

a first footpad electrode having a length of at least one meter;

a first handrail electrode wherein a length of the first handrail electrode runs generally parallel to the length of the first footpad electrode; and control circuitry coupled to the first footpad electrode and the first handrail electrode, and operable to determine if the garment worn by the person passes a soundness test by taking a measurement as the person walks the first piece of footwear along the first footpad electrode while contacting a first hand to the first handrail electrode.

2. The static electricity monitor as recited in claim 1, wherein the control circuitry is further operable to apply a current to at least one of the first footpad electrode and the first handrail electrode.

3. The static electricity monitor as recited in claim 2, wherein the control circuitry further comprises an ohmmeter operable to measure a resistance between the first footpad electrode and the first handrail electrode in order to determine if the garment worn by the person passes the soundness test.

4. The static electricity monitor as recited in claim 1, wherein:

the garment further comprises a second piece of footwear worn on a second foot of the person;

the static electricity monitor further comprising a second footpad electrode having a length of at least one meter and running generally parallel to the first footpad electrode; and the control circuitry is further operable to determine if the garment worn by the person passes the soundness test by taking a measurement as the person walks the second piece of footwear along the second footpad electrode while contacting the first hand to the first handrail electrode.

5. The static electricity monitor as recited in claim 4, further comprising a second handrail electrode running generally parallel to the second footpad electrode, wherein the control circuitry is further operable to determine if the garment worn by the person passes the soundness test by taking a measurement as the person walks the second piece of footwear along the second footpad electrode while contacting a second hand to the second handrail electrode.

6. The static electricity monitor as recited in claim 1, further comprising a second handrail electrode running generally parallel to the first footpad electrode, wherein the control circuitry is further operable to determine if the garment worn by the person passes the soundness test by taking a measurement as the person walks the first piece of footwear along the first footpad electrode while contacting a second hand to the second handrail electrode.

7. The static electricity monitor as recited in claim 1, further comprising:

a first sensor operable to detect when the person enters a testing zone associated with the static electricity monitor; and a second sensor operable to detect when the person exits the testing zone associated with the static electricity monitor.

8. The static electricity monitor as recited in claim 1, further comprising:

a second handrail electrode in-line with the first handrail electrode and running generally parallel to the first footpad electrode, wherein the second handrail electrode is electrically insulated from the first handrail electrode;

a first sensor operable to detect when the person enters a first testing zone associated with the first handrail electrode; and a second sensor operable to detect when the person enters a second testing zone associated with the second handrail electrode.

9. The static electricity monitor as recited in claim 1, wherein the control circuitry is further operable to activate an alarm if the garment worn by the person does not pass the soundness test.

10. The static electricity monitor as recited in claim 1, further comprising a gate near an exit of a testing zone associated with the static electricity monitor, wherein the control circuitry is further operable to unlock the gate prior to the person reaching the gate if the garment worn by the person passes the soundness test.

11. A method of testing a soundness of a garment worn by a person, the garment comprising a first piece of footwear worn on a first foot of the person, the method comprising:

the person walking the first piece of footwear along a first footpad electrode while contacting a first hand to a first handrail electrode, wherein a length of the first handrail electrode runs generally parallel to a length of the first footpad electrode;

taking a measurement between the first footpad electrode and the first handrail electrode; and determining whether the garment worn by the person passes a soundness test based on the measurement.

12. The method as recited in claim 11, wherein taking the measurement comprises applying a current to at least one of the first footpad electrode and the first handrail electrode and measuring a resistance.

13. The method as recited in claim 11, wherein:

the garment further comprises a second piece of footwear worn on a second foot of the person; and the measurement is taken as the person walks the second piece of footwear along a second footpad electrode while contacting the first hand to the first handrail electrode.

14. The method as recited in claim 13, wherein:

the measurement is taken as the person walks the second piece of footwear along the second footpad electrode while contacting a second hand to a second handrail electrode.

15. The method as recited in claim 11, wherein:

the measurement is taken as the person walks the first piece of footwear along the first footpad electrode while contacting a second hand to a second handrail electrode.

16. The method as recited in claim 11, further comprising:

detecting when the person enters a testing zone associated with the first footpad electrode; and detecting when the person exits the testing zone associated with the first footpad electrode.

17. The method as recited in claim 11, further comprising:

the person walking the first piece of footwear along the first footpad electrode while contacting the first hand to a second handrail electrode, wherein the second handrail electrode is in-line with the first handrail electrode and electrically insulated from the first handrail electrode;

taking a measurement between the first footpad electrode and the second handrail;

detecting when the person enters a first testing zone associated with the first handrail electrode; and detecting when the person enters a second testing zone associated with the second handrail electrode.

18. The method as recited in claim 11, further comprising activating an alarm if the garment worn by the person does not pass the soundness test.

19. The method as recited in claim 11, further comprising unlocking a gate prior to the person reaching the gate if the garment worn by the person passes the soundness test.

* * * * *